US006058549A

United States Patent [19]

Milward-Bason

[11] Patent Number: 6,058,549

[45] **Date of Patent: *May 9, 2000**

[54] TWIST MOP

[75] Inventor: Anthony Harold Milward-Bason, Seaford, Australia

[73] Assignee: Anthony Harold Milward-Bason, Australia

[ * ] Notice: This patent issued on a continued prosecution application filed under 37 CFR 1.53(d), and is subject to the twenty year patent term provisions of 35 U.S.C. 154(a)(2).

[21] Appl. No.: 08/802,553

[22] Filed: Feb. 19, 1997

[30] Foreign Application Priority Data

Feb. 19, 1996 [AU] Australia ..... 8149/96
Jan. 30, 1997 [AU] Australia ..... 12432/97

[51] Int. Cl.[7] ..... A47L 13/142

[52] U.S. Cl. ..... 15/120.1; 15/120.2

[58] Field of Search ..... 15/116.1, 116.2, 15/119.1, 119.2, 120.1, 120.2, 228, 229.1

[56] References Cited

U.S. PATENT DOCUMENTS

| | | | |
|---|---|---|---|
| 1,520,500 | 12/1924 | Jumonville | 15/120.2 |
| 4,130,910 | 12/1978 | Raven . | |
| 4,479,278 | 10/1984 | Heinonen | 15/120.2 |
| 5,566,417 | 10/1996 | Hsieh | 15/120.1 |

FOREIGN PATENT DOCUMENTS

| | | | |
|---|---|---|---|
| B-27875/77 | 2/1977 | Australia . | |
| 42565/78 | 6/1979 | Australia . | |
| B-28484/84 | 5/1984 | Australia . | |
| 79651/91 | 12/1991 | Australia . | |
| 902835 | 11/1985 | Belgium . | |
| 2114879 | 9/1983 | United Kingdom | 15/229.1 |
| 2115688 | 9/1983 | United Kingdom . | |
| WO 91/19450 | 12/1991 | WIPO | 15/119.1 |

*Primary Examiner*—Terrence R. Till
*Attorney, Agent, or Firm*—Morrison & Foerster LLP

[57] ABSTRACT

A twist mop having a handle, a wringing actuator, and a mop head into which an end portion of the mop handle extends and which is releasably and substantially irrotationally coupled at first and second opposite ends thereof respectively to said end portion of the mop handle and to the actuator, the actuator being movable relative to the handle to effect torsional wringing of the mop head; the mop head being demountable from the handle and actuator by decoupling it from the actuator and from said end portion of the handle and withdrawing said end portion of the handle from the mop head in the direction from said first to said second end of the mop head.

22 Claims, 5 Drawing Sheets

TWIST MOP

BACKGROUND OF THE INVENTION

Conventional twist mops generally comprise a handle, a mop head having first and second opposite ends, and a wringing actuator that is movable relative to the handle to effect torsional wringing of the mop head. Torsional wringing of the mop head can only be effected if the first and second opposite ends of the mop head are substantially irrotationally coupled respectively to the handle and the wringing actuator.

Previously proposed arrangements for substantially irrotationally coupling the first and second opposite ends of the mop head respectively to the handle and the wringing actuator have typically comprised a first frustoconical shaped cup with an internal threaded portion formed therein that is connected to the lower end of the handle by conventional fastening means, and a second frustoconical shaped cup with ridges or shoulders thereon that is formed integral on the lower end of the wringing actuator. The mop head is substantially irrotationally secured to the first frustoconical cup by a coupling member that has a flange on its lower end and a threaded portion on its upper end. The coupling member is inserted through a first annular tie at the first end of the mop head and the threaded portion on the coupling member threadedly engages the threaded portion on the inside of the first frustoconical cup. The flange on the coupling member retains the first annular tie in the first frustoconical cup and substantially prevents the first end of the mop head from rotating with respect to the handle. The mop head is substantially irrotationally coupled to the second frustoconical cup by a second annular tie at the second opposite end of the mop head which has a circumferential dimension smaller than the largest circumferential dimension of the second frustoconical cup. The shoulders or ridges on the second frustoconical cup bear against the second annular tie at the second opposite end of the mop head to substantially prevent the mop head from rotating with respect to the wringing actuator.

A particular disadvantage of previously proposed twist mops is that, because the second annular tie at the second end of the mop head has a circumferential dimension smaller than the largest circumferential dimension of the second frustoconical cup, removal and replacement of the mop head requires passing the mop head over the handle. In instances where the mop head is being removed for washing and cleaning after use, passing the unclean mop head over the handle presents health and hygiene risks, especially if the twist mop is being used in hazardous environments. A further disadvantage of previously proposed twist mops is that, because two different means of securing the mop head are used simultaneously, the mop head cannot readily be reversed to allow wear to be more evenly distributed over the surface of the mop head.

A requirement accordingly exists for a twist mop wherein the mop head can be releasably and substantially irrotationally coupled to the handle and the wringing actuator without having to pass the mop head over the handle. A requirement also exists for a reversible mop head for use in such a twist mop wherein the first and second opposite ends thereof can be interchangeably releasably and substantially irrotationally coupled to the handle and the wringing actuator such that the mop head can be reversed to allow wear to be more evenly distributed over the surface of the mop head. Preferably, the foregoing improvements should not hamper the industrial large scale, and low cost, production of the twist mop.

SUMMARY OF THE INVENTION

In general, according to a first aspect of the invention, there is provided a twist mop having a handle, a wringing actuator, and a mop head into which an end portion of the mop handle extends and which is releasably and substantially irrotationally coupled at first and second opposite ends thereof respectively to said end portion of the mop handle and to the actuator, the actuator being movable relative to the handle to effect torsional wringing of the mop head; the mop head being demountable from the handle and actuator by decoupling it from the actuator and from said end portion of the handle and withdrawing said end portion of the handle from the mop head in the direction from said first to said second end of the mop head.

In another aspect, the invention provides a twist mop having a handle structure and a mop head, the handle structure having an elongate mop handle and a wringing actuator movable lengthwise of and rotatable about the mop handle, the mop head including flexible mopping means, the handle and actuator being provided with first elements of respective first and second mop head coupling means, and the mop head being provided at respective first and second opposite ends thereof with respective second elements of the respective first and second coupling means; the first and second coupling elements of the first coupling means substantially irrotationally and releasably coupling the handle to the first end of the mop head and the first and second coupling elements of the second coupling means substantially irrotationally and releasably coupling the actuator to the second end of the mop head, movement of the actuator lengthwise of the handle towards an end of the handle at which said mop head is located outwardly distending the mopping means for use of the twist mop, and movement of the actuator lengthwise of the handle away from said end thereof the mopping means is caused to assume a position generally parallel to and adjacent the handle whereby rotation of the actuator relative to the handle effects torsional wringing of the mopping means; the coupling elements of the first and second coupling being formed whereby the mopping means is demountable from the handle structure by decoupling the first and second coupling elements of the first and second coupling means, and withdrawing the handle and first coupling elements through the mopping means and the second coupling elements in the direction from said first to said second end of the mop head.

Preferably, the handle structure consists of a handle comprising an elongated inner member and a wringing actuator comprising an outer member coaxially mounted on the inner member and adapted for longitudinal and rotational movement therewith. The first elements of respective first and second mop head coupling means are preferably provided on the lower end portions of the handle and actuator and conveniently respectively comprise a first and second cup each having a threaded portion provided therein.

Preferably, the first cup has an upper opening with an internal threaded portion, and a lower opening with an internal threaded portion, formed therein. The first cup is conveniently connected to the end portion of the handle by a connection piece having first and second opposite ends. Preferably, the first end of the connection piece is connected to the end portion of the handle by conventional fastening means. The second opposite end of the connection piece is preferably provided with a threaded portion that threadedly engages the upper internal threaded portion of the first cup, thereby coupling the first cup to the end portion of the handle. The use of the connection piece is preferred because it allows the first cup to be removably coupled to the handle to allow the handle to be interchangeably used with an array of alternate cleaning heads as required.

Preferably, the second cup is formed integral on the end portion of the wringing actuator. Conveniently, the second cup is formed with retaining means for substantially irrotationally retaining therein an annular sleeve having a threaded portion formed on its inside. The retaining means may consist of a lip or a series of grooves or ridges, or a combination of both. The use of a separate threaded annular sleeve is preferred because it allows the wringing actuator to be manufactured by conventional blow moulding. Those particularly experienced in the art of moulded plastic components will also appreciate that the wringing actuator can also be manufactured by the conventional injection moulding process, but dies for which would likely be more expensive, particularly where dies having more than one cavity are a consideration, than blow moulding.

In yet another aspect, the invention provides a mop head for use in the twist mop above described, wherein the second elements of the respective first and second coupling means provided at respective first and second opposite ends of the mop head are capable of interchangeably substantially irrotationally and releasably coupling with the first elements of respective first and second mop head coupling means provided on the handle and actuator such that the mop head can be reversibly mounted on the handle and actuator.

Preferably, the flexible mopping means of the mop head comprise strands that are provided at first and second opposite ends with respective second elements of the respective first and second coupling means. The strands may be synthetic or cotton fibre, or a combination of both.

The second elements of respective first and second mop head coupling means are preferably annular members that are generally identical in construction and have a first end having a threaded portion formed thereon and a second opposite end with retaining means, such as one or two annular flanges, formed thereon. Where the retaining means comprise two annular flanges, the first and second opposite ends of the strands of the mop head are conveniently retained therebetween by annular ties. Where the retaining means comprise only one annular flange, the annular ties provided at the first and second opposite ends of the strands of the mop head are conveniently retained between the annular flange formed on the end of the annular member and a separate washer.

Preferably, the threaded portions formed on each of the annular members are capable of interchangeably threadedly engaging the threaded portions provided inside the first and second cups. Conveniently, the two annular members are arranged such that both have the same general orientation notwithstanding the fact that they are disposed at first and second opposite ends of the mop head—that is, the annular member at the first end of the mop head has the same orientation as the annular member at the second opposite end of the mop head such that the threaded portion of one annular member is internal of the mop head and the threaded portion of the other annular member is external of the mop head. This arrangement allows the mop head to be reversed by simply reversing the orientation of both annular members and rearranging the strands of the mop head such that they generally extend between the two annular members—that is, reversal of the mop head may be effected by rotating each annular member about their lower ends through 180 degrees such that the threaded portions pass through the strands of the mop head and reversibly assume an orientation wherein the threaded portion of one annular member is internal of the mop head and the threaded portion of the other annular member is external of the mop head. The reversibility of the mop head facilitates more even distribution of wear over the surface of the mop head.

Conveniently, the handle and the wringing actuator are each provided with handle means to assist in the effecting of torsional wringing of the mop head. The handle means are preferred to be generally disposed about the upper end portions of the handle and the wringing actuator. Preferably, the handle means provided on the upper portion of the handle are arranged to limit the upper vertical extent of longitudinal movement that the wringing actuator can undergo with respect to the handle to prevent the wringing actuator from becoming separated from the handle. In such case, it is also preferred that the lowermost portion of the handle means provided on the upper portion of the handle and/or the uppermost portion of the wringing actuator be provided with a number of removable segments formed thereon. Removal of the segments (for example, by cutting with a knife) allows the range of longitudinal movement that the wringing actuator can undergo with respect to the handle to be incrementally increased. By increasing the range of longitudinal movement of the wringing actuator, and in particular the upper vertical extent of longitudinal movement, the length of the strands of the mop head, and hence the overall size of the mop head, can be increased. Thus, the removable segments of the wringing actuator allow larger mop heads to be fitted when necessary.

BRIEF DESCRIPTION OF THE DRAWINGS

Embodiments of the invention will now be described by way of example with reference to the accompanying drawings in which.

DETAILED DESCRIPTION OF THE PREFERRED EMBODIMENTS

Figure 1:
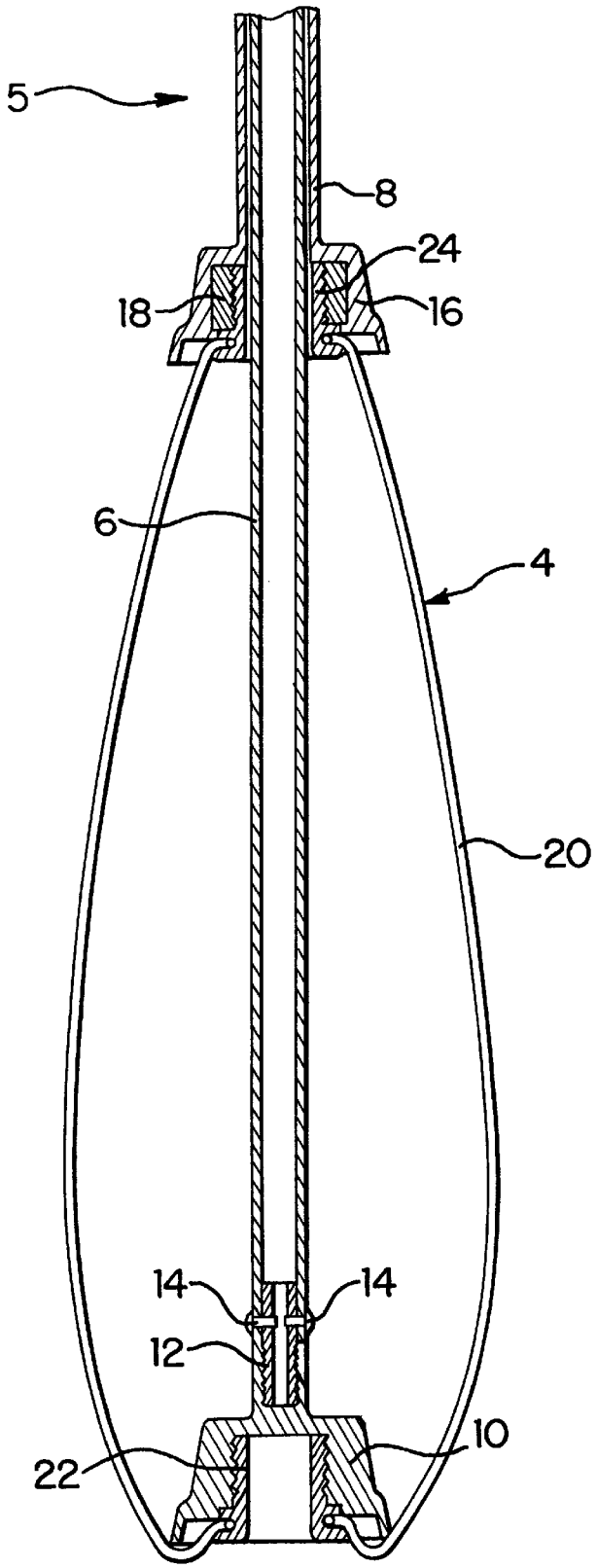
FIG. 1 is a sectioned view of the lower end of a twist mop according to a preferred embodiment of the invention.

As shown in the accompanying drawings, a twist mop 2 in accordance with the preferred embodiment of the invention generally comprises a mop head 4, and a handle structure 5. The handle structure 5 consists of a handle 6 comprising an elongated inner hollow shaft, and a wringing actuator 8 comprising an outer tube coaxially mounted on the inner shaft and adapted for longitudinal and rotational movement therewith. Unless otherwise indicated, it is preferred that the structural components of the twist mop be generally constructed of materials commonly used in conventional twist mops—for example, aluminium for the inner shaft and moulded plastics for the remaining components.

The handle 6 is connected at its lower end to a first cup 10 via a cylindrical connection piece 12. The first cup 10 has an upper opening with an internal threaded portion, and a lower opening with an internal threaded portion, formed therein. The upper end of the cylindrical connection piece 12 has a circumferential dimension that is slightly less than the internal circumferential dimension of the hollow inner shaft of the handle 6 such that it snugly fits inside the inner shaft and is retained therein by pop rivets 14 or alternate conventional fastening means. The cylindrical connection piece 12 has a threaded portion on its lower end that threadedly engages the upper internal threaded portion of the first cup 10, thereby removably coupling the first cup 10 to the end portion of the handle 6. The use of the cylindrical connection piece is preferred because it allows the first cup to be removably coupled to the handle to allow the handle to be interchangeably used with an array of alternate cleaning heads such as brooms, squeegees, dusters etc., as required.

The wringing actuator 8 has a second cup 16 formed integral on the lower end of the outer tube. Retaining means (not shown) are integrally formed on the inside of the second cup 16 for substantially irrotationally retaining therein an annular sleeve 18 having a threaded portion formed on its inside. The retaining means may consist of a lip or a series of grooves, or a combination of both. The use of a separate threaded annular sleeve is preferred because it allows the wringing actuator to be manufactured by conventional blow moulding.

The mop head 4 comprises synthetic or cotton fibre (or a combination of both) strands 20 that are provided at first and second opposite ends thereof with annular members 22, 24. The annular members 22, 24 are generally identical in construction and have a first end having a threaded portion formed thereon and a second opposite end with two annular flanges formed thereon. The first and second opposite ends of the strands 20 of the mop head 4 are retained between the two annular flanges formed on the annular members 22, 24 by annular ties (not shown). In an alternate embodiment, the annular ties (not shown) provided at the first and second opposite ends of the strands 20 of the mop head 4 are conveniently retained between a single annular flange formed on the end of the annular members 22, 24 and a separate washer (not shown).

The threaded portions formed on each of the annular members 22, 24 are capable of interchangeably threadedly engaging the threaded portions provided on the inside of the first and second cups 10, 16. Importantly, the two annular members 22, 24 are arranged such that both have the same general orientation notwithstanding the fact that they are disposed at first and second opposite ends of the mop head 4—that is, the annular member 22 at the first end of the mop head 4 has the same orientation as the annular member 24 at the second opposite end of the mop head 4 such that the threaded portion of annular member 24 is external of the mop head and the threaded portion of annular member 22 is internal of the mop head. This arrangement allows the mop head 4 to be reversed by simply reversing the orientation of both annular members 22, 24 and rearranging the strands 20 of the mop head 4 such that they generally extend between the two annular members 22, 24—that is, reversal of the mop head may be effected by rotating each annular member about their lower ends through 180 degrees such that the threaded portions pass through the strands of the mop head and reversibly assume an orientation wherein the threaded portion of one annular member is internal of the mop head and the threaded portion of the other annular member is external of the mop head. The reversibility of the mop head 4 facilitates more even distribution of wear over the surface of the mop head.

Figure 2:
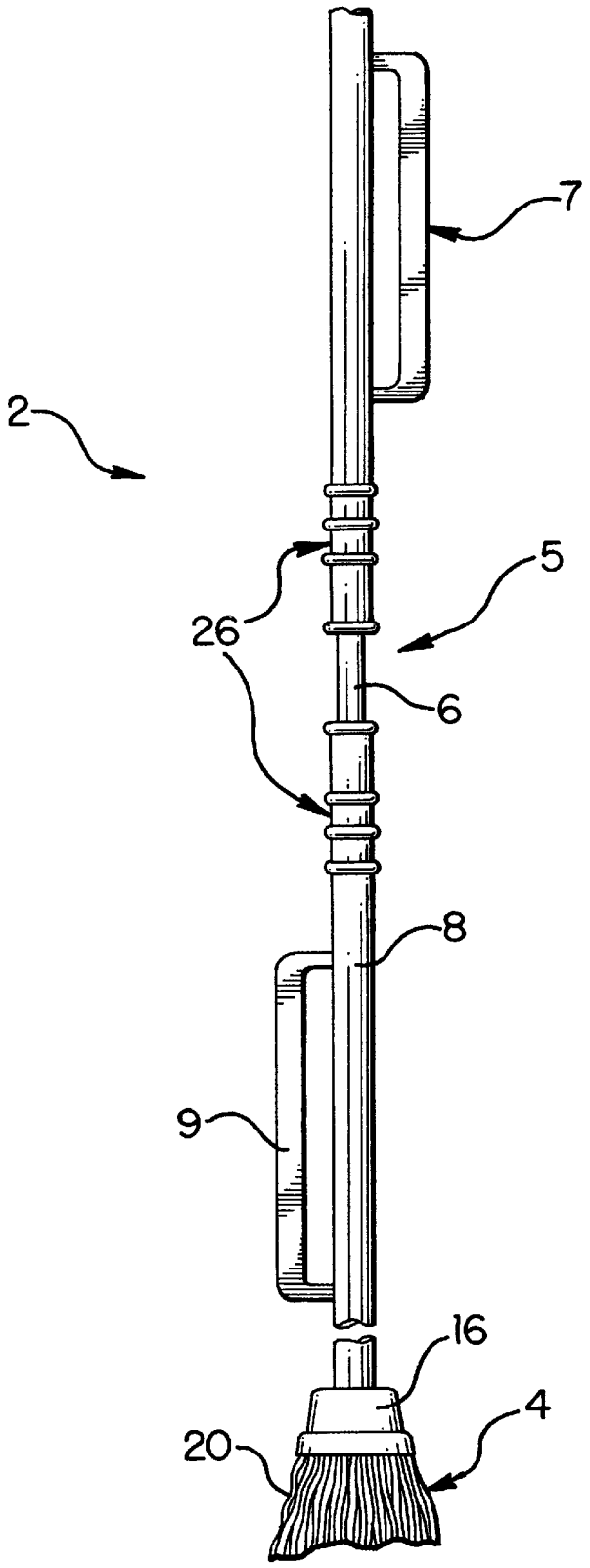
FIG. 2 is a view of the middle portion of the preferred embodiment of the invention depicted in FIG. 1.

As shown in FIG. 2, the handle 6 and the wringing actuator 8 are each provided with handle means 7, 9 to assist in effecting torsional wringing of the mop head 4. The handle means 7 provided on the upper portion of the handle 6 are arranged to limit the upper vertical extent of longitudinal movement that the wringing actuator 8 can undergo with respect to the handle 6 to prevent the wringing actuator 8 from passing over the upper end of the handle 6 and becoming separated therefrom. The lowermost portion of the handle means 7 provided on the upper portion of the handle 6 and the uppermost portion of the wringing actuator 8 are each provided with a number of evenly spaced removable segments 26 formed thereon. Removal of the segments 26 (for example, by cutting with a knife) has the effect of incrementally increasing the range of longitudinal movement which the wringing actuator 8 can undergo with respect to the handle 6 before contacting the handle means 7 provided on the upper end of the handle 6. By increasing the range of longitudinal movement that the wringing actuator 8 can undergo before contacting the handle means 7 (that is, the upper vertical extent of longitudinal movement), the length of the strands 20 of the mop head 4, and hence the overall size of the mop head 4, can be increased. Thus, the removable segments allow larger mop heads to be fitted when necessary.

The mop head 4 is mounted on the handle structure 5 of the twist mop 2 by passing the handle 6 (with the first cup 10 removed) through an annular member having the threaded portion uppermost such that a lower end portion of the handle 6 extends into the mop head 4. After the first cup 10 has been recoupled to the handle 6 via connection piece 12, the mop head 4 can be substantially irrotationally and releasably coupled to the handle 6 and the wringing actuator 8 by threadedly engaging the threaded portions provided on the annular members 22, 24 of the mop head 4 with the threaded portions provided on the inside of the first and second cups 10, 16. Significantly, because the annular locking members 22, 24 are capable of interchangeably engaging the threaded portions on the inside of the first and second cups 10, 16, it is possible to reversibly mount the mop head 4 on the handle structure 5 of the twist mop 2 to more evenly distribute wear over the surface of the mop head 4.

The strands 20 of the mop head 4 may be distended for use by moving the wringing actuator 8 longitudinally towards the lower end of the handle 6 to bring the first end of the mop head 4 into proximity to the second opposite end of the mop head 4 to cause the strands 20 of the mop head 4 to form loops that can thereafter be used to effect mopping. The foregoing can alternatively and most practically be achieved by first moving the wringing actuator 8 in an upwards direction along the handle 6 and then allowing the wringing actuator 8 to drop vertically away along the handle 6 thus distending the strands 20 of the mop head 4 into loops while retaining a grip on handle means (not shown) provided on the upper end of the handle 6. The loops thus formed can then be flared out by a quick twist or rotation of handle means 7 and putting the flared out loops of the mop head 4 on the floor to effect mopping.

To expel water from the mop head 4 after mopping or during the course of mopping when required, the wringing actuator 8 is first moved longitudinally upwards along the handle 6 to extend the mop strands 20 of the mop head 4 such that they assume a position generally parallel to and adjacent the handle 6. The wringing actuator 8 is then rotated about the handle 6 in a direction that is the same as the direction the annular locking member's 22, 24 threads that substantially irrotationally and releasably couple the mop head 4 to the respective parts 6, 8 of the handle structure 5 of the twist mop 2. This will subject the mop head 4 to a torsional wringing action that will expel the water from the strands 20 of the mop head 4.

Rotating the wringing actuator 8 about the handle 6 in a direction opposite to the direction the annular locking member's 22, 24 threads that substantially irrotationally and releasably couple the mop head 4 to the respective parts 6, 8 of the handle structure 5 of the twist mop 2, will end to predispose the mop head 4 to decoupling from the first cup 10 to potentially hamper the torsional wringing of the mop head 4. Additionally, the direction of the thread on the lower end of the cylindrical connection piece 12 that couples the first cup 10 to the lower end of the handle 6 should have the same direction as the threads on the annular locking members 22, 24 that substantially irrotationally and releasably couple the mop head 4 to the respective parts 6, 8 of the handle structure 5 of the twist mop 2. If the direction of the thread on the lower end of the cylindrical connection piece 12 is otherwise, rotation of the wringing actuator 8 to effect torsional wringing of the mop head 4 will tend to predispose the first cup 10 to decouple from the lower end of the handle 6 at the lower end of the cylindrical connection piece 12. To prevent unintentional decoupling of the mop head 4 from the first cup 10 and/or the second cup 16 during use, it may be necessary to use a specific type of thread or other analogous coupling method.

The mop head 4 may be demounted from the handle structure 5 of the twist mop 2 by threadedly disengaging the threaded portions provided on the annular members 22, 24 of the mop head 4 from the threaded portions provided on the inside of the first and second cups 10, 16. After removal of the first cup 10 from the lower end of the handle 6, the lower end of the handle 6 may be withdrawn from the mop head 4 until the lower end of the handle 6 is clear of both first and second opposite ends of the mop head 4. The mop head may then be removed and cleaned. Alternatively, the above general demounting procedure may be repeated without separating the mop head 4 from the first cup 10, in which case the mop head 4 may conveniently be removed and cleaned while remaining coupled to the first cup 10. This modified demounting method facilitates simpler and more hygienic removal and cleaning of the mop head 4. It will be therefore be appreciated that an unclean mop head can be removed from the above embodiment for cleaning without having to be passed over the mop handle. The mop head may then optionally be reversed to more evenly distribute wear over the surface of the strands and remounted on the handle structure of the twist mop.

Figure 3:
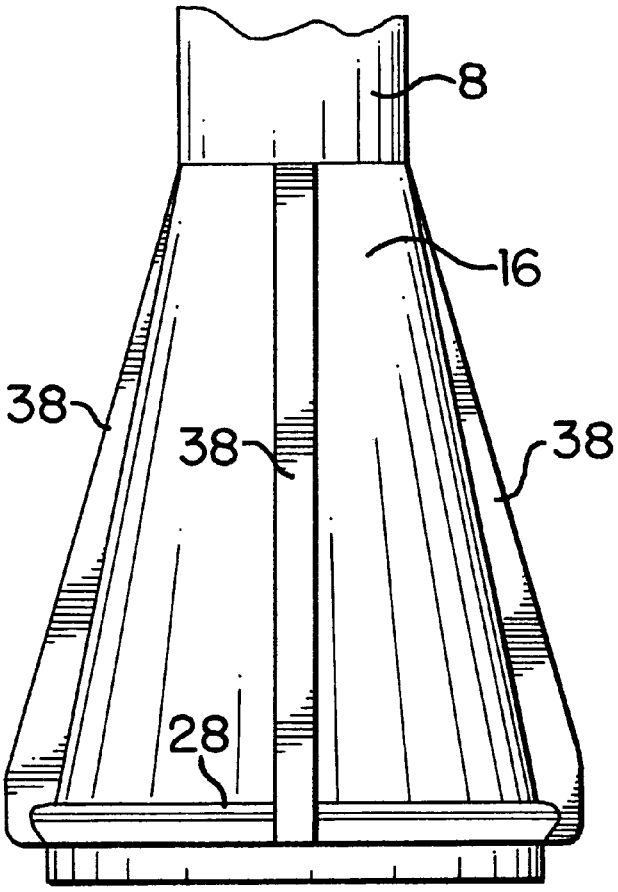
FIG. 3 is a view of a modified second cup for use in an alternate embodiment of the invention.
Figure 4:
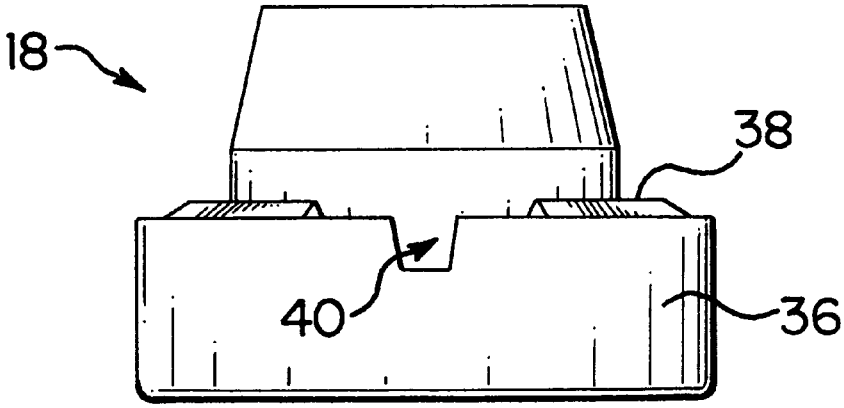
FIG. 4 is a view of modified annular sleeve for use with the second cup illustrated in FIG. 3.
Figure 5:
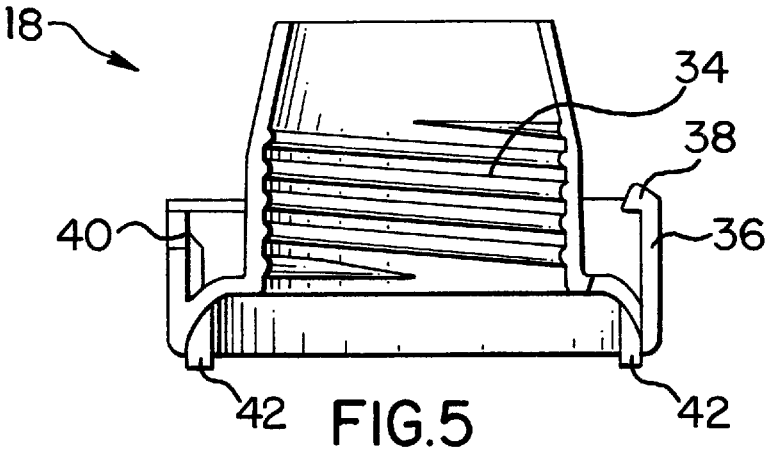
FIG. 5 is a sectioned view of the modified annular sleeve illustrated in FIG. 4.

FIGS. 3 to 9 illustrate an alternate embodiment of the present invention wherein certain components of the twist mop 2 have been modified to reduce any tendency the mop head 4 may have to unintentionally decouple from first cup 110 and/or the second cup 16 during use. As illustrated in FIG. 3, a modified second cup 16 is frustoconically shaped and formed integral on the end portion of the wringing actuator 8. Retaining means are integrally formed on the outside of the second cup for substantially irrotationally mounting the modified annular sleeve 18 illustrated in FIG. 4. The retaining means include an outwardly projecting lip 28 formed about the circumferential bottom edge of the second cup 16 and a plurality of linear ridges 30 that extend perpendicular from the circumferential lip 28 along the outer surface of the second cup 16. As best illustrated in FIG. 5, the modified annular sleeve 18 has a threaded portion 34 formed on its inside and a coaxially arranged external collar 36 provided about the lower circumferential edge of the threaded portion 34. The upper circumferential edge of the external collar 36 is provided with a plurality of inwardly projecting lip segments 38 and a plurality of generally U-shaped recesses 40 arranged such that a U-shaped recess 40 is intermediate adjacent lip segments 38. The external collar 36 of the modified annular sleeve 18 interconnects by press fitting with the retaining means formed on the second cup 16 to substantially irrotationally mount the modified annular sleeve 18 thereon. Specifically, the lip segments 38 formed on the external collar 36 clip over the lip 28 formed on the circumferential bottom edge of the second cup and the U-shaped recesses 40 receive, and interlock with, the linear ridges 30 formed on the outer surface of the second cup 16.

Figure 8:
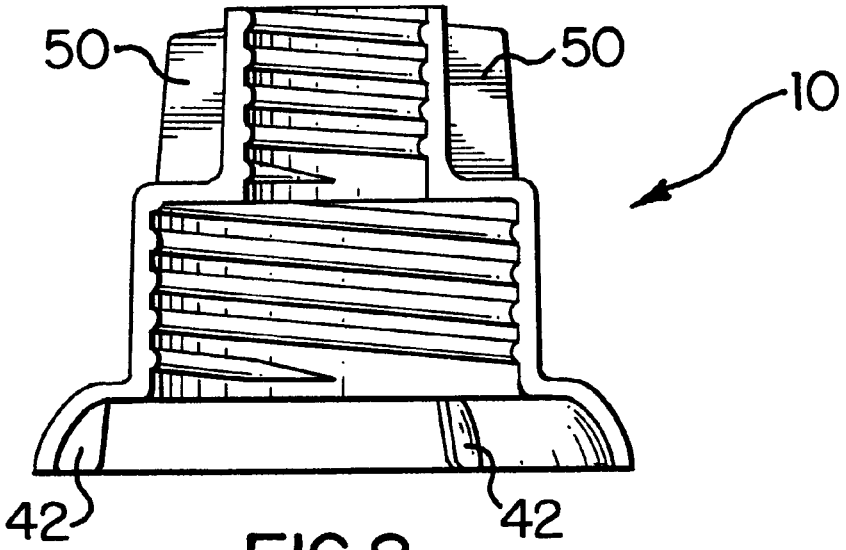
FIG. 8 is a sectioned view of a modified first cup for use in an alternate embodiment of the invention.
Figure 9:
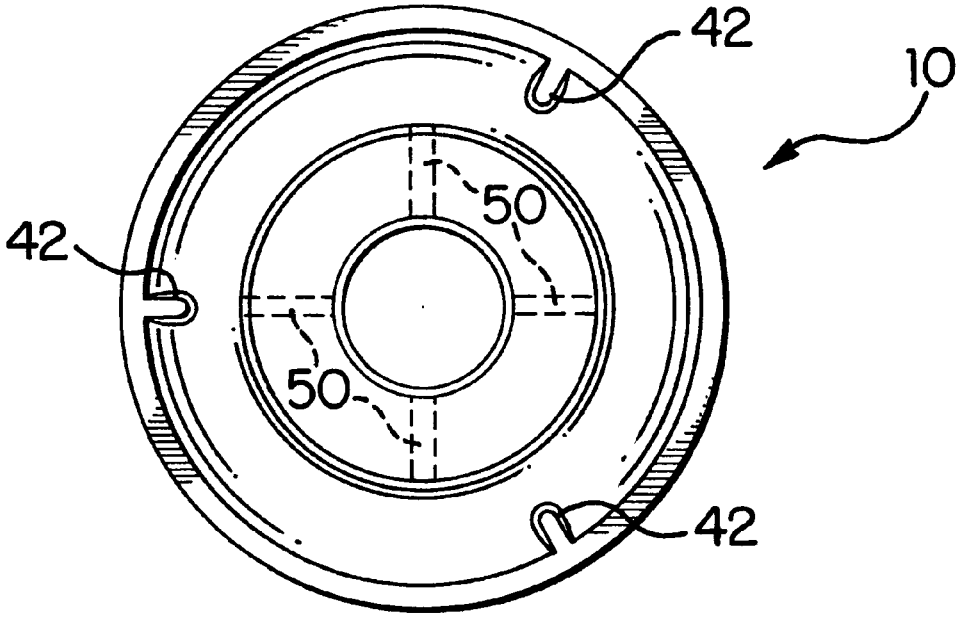
FIG. 9 is a bottom view of the first cup illustrated in FIG. 8.

As illustrated in FIGS. 5, 8 and 9, locking lugs 42 and 142 are circumferentially arranged inside the annular sleeve 18 of the second cup 16, and inside the first cup 110, for biting the strands 20 of the mop head 4 when the annular members 22, 24 are in threaded engagement with the first and second cups 110, 16 to reduce any tendency the mop head 4 may have to unintentionally decouple from the first and second cups 110, 16 during torsional wringing of the twist mop 2.

Figure 6:
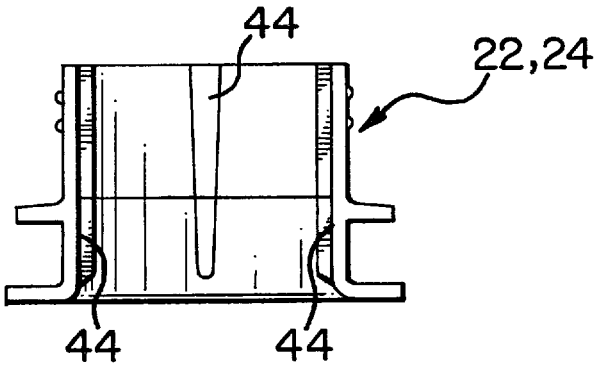
FIG. 6 is a sectioned view of a modified annular member for use in an alternate embodiment of the invention.
Figure 7:
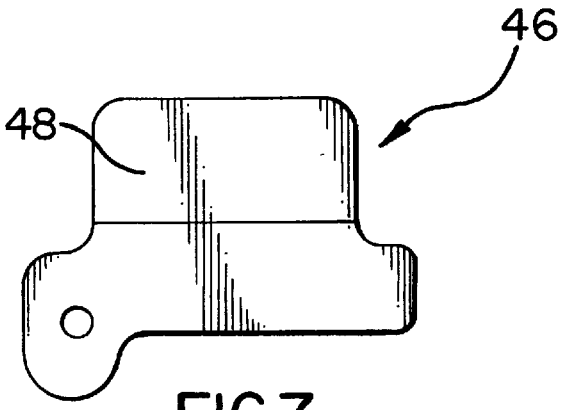
FIG. 7 is a view of a key for use with the modified annular member illustrated in FIG. 6.

Decoupling means are also provided to facilitate decoupling of the mop head 4 from the first and second cups 110, 16 for removal and replacement of the mop head 4. As illustrated in FIG. 6, the first elements of the decoupling means provided in respect of the first and second cups 110, 16 comprise a plurality of axially arranged linear ridges 44 formed inside modified annular members 22, 24. As illustrated in FIG. 6, the second element of the decoupling means provided in respect of the first cup 110 comprises a rectangular shaped key 46 having a portion 48 dimensioned to fit inside modified annular members 22, 24. It will be appreciated that in use the key 46 engages with the ridges 44 provided inside the annular members 22, 24 such that the key 46 may be rotated to decouple an annular member 22, 24 from the first cup 10. As illustrated in FIGS. 8 and 9, the second element of the decoupling means provided in respect of the second cup 16 comprises a plurality of axially arranged ridges 50 formed on the outside of the upper end of the first cup 110. The upper end of the first cup 110 and the ridges 50 formed thereon are dimensioned to engage the ridges 44 formed inside modified annular members 22, 24. In use, the wringing actuator 8 is moved longitudinally relative to the handle 6 until the ridges 50 formed on the outside of the upper end of the first cup 110 engage the ridges 44 formed inside an annular member 22, 24 in threaded engagement with the second cup 16, whereupon the wringing actuator 8 may be rotated relative to the handle 6 to decouple an annular member 22, 24 from the second cup 16.

As the foregoing suggests, preferred embodiments of the invention provide an improved twist mop that is capable of industrial large scale production wherein the mop head can be releasably and substantially irrotationally coupled to the handle structure of the twist mop without having to pass the mop head over the handle structure of the twist mop, and wherein the mop head can be reversibly secured to the handle structure of the twist mop such that wear can be distributed more evenly over the surface of the mop head. Moreover, the embodiments described above allow for larger mop heads or alternate cleaning heads to be coupled to the handle of the mop as required.

The above embodiments have been described by way of example only and modifications are possible within the scope of the invention.

The invention claimed is:

1. A twist mop comprising a handle, a wringing actuator, and a mop head into which an end portion of the mop handle extends, the mop head being releasably and substantially irrotationally coupled at first and second opposite ends thereof respectively to said end portion of the mop handle and to the actuator, the actuator being moveable relative to the handle to effect torsional wringing of the mop head; the mop head being demountable from the handle and the actuator, without passing the mop head over the handle in a direction away from said end portion of the handle, by decoupling the mop head from the actuator and from said end portion of the handle and withdrawing said end portion of the handle from the mop head in a direction from said first to said second end of the mop head, the respective first and second opposite ends of the mop head being interchangeably substantially irrotationally and releasably couplable to the handle and the actuator such that the mop head can be reversibly mounted on the handle and the actuator.

2. A twist mop comprising a handle structure and a mop head, the handle structure including an elongate mop handle and a wringing actuator which is moveable lengthwise of and rotatable about the mop handle, the mop head including flexible mopping means, the handle and the actuator being provided with first elements of respective first and second coupling means, and the mop head being provided at respective first and second opposite ends thereof with respective second elements of the respective first and second coupling means; the first and second coupling elements of the first coupling means substantially irrotationally and releasably coupling the handle to the first end of the mop head and the first and second coupling elements of the second coupling means substantially irrotationally and releasably coupling the actuator to the second end of the mop head, movement of the actuator is lengthwise of the handle towards an end of the handle at which said mop head is located outwardly distending, the mopping means for use of the twist mop, and movement of the actuator is lengthwise of the handle away from said end thereof causing the mopping means to assume a position generally parallel to and adjacent the handle whereby rotation of the actuator relative to the handle effects torsional wringing of the mopping means; the coupling elements of the first and second coupling means being formed whereby the mopping means is demountable from the handle structure, without passing the mop head over the handle in a direction away from an end portion of the handle, by decoupling the first and second coupling elements of the first and second coupling means, and withdrawing the end portion of the handle through the mopping means and the second coupling element of the second coupling means in a direction from said first to said second end of the mop head; the second elements of the respective first and second coupling means provided at respective first and second opposite ends of the mop head being capable of interchangeably substantially irrotationally and releasably coupling with the first elements of the respective first and second coupling means provided on the handle and the actuator such that the mop head can be reversibly mounted on the handle and the actuator.

3. A twist mop according to claim 2, wherein the first elements of respective first and second coupling means are provided on the lower end portions of the handle and actuator and respectively comprise a first and second cup.

4. A twist mop according to claim 3, wherein a connection piece interconnects the first cup to the lower end portion of the handle.

5. A twist mop according to claim 3, wherein the first cup has a threaded portion formed on its inside.

6. A twist mop according to claim 3, wherein the second cup is formed integral on the lower end portion of the wringing actuator.

7. A twist mop according to claim 6, wherein the second cup is formed with retaining means for substantially irrotationally retaining thereon an annular sleeve, said annular sleeve including a threaded portion formed on its inside.

8. A twist mop according to claim 7, wherein the retaining means include a lip, grooves.

9. A twist mop according to claim 8, wherein the second elements of the respective first and second coupling means are annular members that are generally identical in construction and have a first end having a threaded portion formed thereon, and a second opposite end with means for retaining the flexible mopping means formed thereon.

10. A twist mop according to claim 9, wherein the means for retaining the flexible mopping means include at least one annular flange.

11. A twist mop according to claim 9, wherein locking means are provided inside the first cup and the annular sleeve of the second cup for biting the flexible mopping means when the annular members are in threaded engagement with the first and second cups.

12. A twist mop according to claim 11, wherein the locking means comprise lugs that are circumferentially arranged inside the first cup and the annular sleeve of the second cup.

13. A twist mop according to claim 11, wherein decoupling means are provided to facilitate decoupling of the mop head from the first and second cups, the decoupling means including a plurality of axially arranged ridges formed inside the annular members.

14. A twist mop according to claim 13, wherein the decoupling means further includes a key having a portion dimensioned to engage the ridges formed inside the annular members.

15. A twist mop according to claim 14, wherein the decoupling means further includes a plurality of axially arranged ridges formed on the outside of the upper end of the first cup, the upper end of the first cup and the ridges formed thereon being dimensioned to engage the ridges formed inside the annular members.

16. A twist mop according to claim 2, wherein the handle comprises an elongated inner member and the wringing actuator comprises an outer member coaxially mounted on the inner member for longitudinal and rotational movement therewith.

17. A twist mop according to claim 16, wherein the handle and the wringing actuator are each provided with handle means to assist in the effecting of torsional wringing of the mop head.

18. A twist mop according to claim 17, wherein the handle means are disposed about the upper end portions of the handle and the wringing actuator.

19. A twist mop according to claim 18, wherein the lowermost portion of the handle means provided on the upper portion of the handle and/or the uppermost portion of the wringing actuator are provided with a number of removable segments formed thereon to allow the range of longitudinal movement that the wringing actuator can undergo with respect to the handle to be selectively incrementally increased.

20. A twist mop comprising a handle structure and a mop head, the handle structure including an elongate mop handle and a wringing actuator which is movable lengthwise of and rotatable about the mop handle, the mop head including flexible mopping means, the handle and the actuator being provided with first elements of respective first and second coupling means, and the mop head being provided at respective first and second opposite ends thereof with respective second elements of the respective first and second coupling means; the first and second coupling elements of the first coupling means substantially irrotationally and releasably coupling the handle to the first end of the mop head and the first and second coupling elements of the second coupling means substantially irrotationally and releasably coupling the actuator to the second end of the mop head, movement of the actuator is lengthwise of the handle towards an end of the handle at which said mop head is located outwardly distending the mopping means for use of the twist mop, and movement of the actuator is lengthwise of the handle away from said end thereof means causing the mopping means to assume a position generally parallel to and adjacent the handle whereby rotation of the actuator relative to the handle effects torsional wringing of the mopping means; the coupling elements of the first and second coupling means being formed whereby the mopping means is demountable from the handle structure, without passing the mop head over the handle in a direction away from an end portion of the handle, by decoupling the first and second coupling elements of the first and second coupling means and withdrawing the end portion of the handle through the mopping means and the second coupling element of the second coupling means in a direction from said first to said second end of the mop head; wherein the first elements of the respective first and second coupling means are provided on lower end portion of the handle and on the actuator and respectively comprise a first and second cup each including a threaded portion provided therein, and the second elements of the respective first and second coupling means are generally identical annular members including a first end with a threaded portion formed thereon and a second opposite end with means for retaining the flexible mopping means formed thereon.

21. A mop head for use in a twist mop comprising a handle and an actuator which is rotationally and suitably mounted on the handle, an end portion of the handle and the actuator including first coupling elements, the mop head including second coupling elements at opposite ends thereof which are interconnected by flexible mopping strands; the second coupling elements being manipulable with respect to the strands so that, in a first condition of the mop head the coupling portion of the second coupling element at one end of the mop head extends inwardly of the mop head towards the second coupling element at the other end of the mop head and the coupling portion of the second coupling element at the other end of the mop head extends outwardly of the mop head away from the second coupling element at said one end of the mop head and, in a second condition of the mop head, the coupling portion of the second coupling element at the other end of the mop head extends inwardly of the mop head towards the second coupling element at the one end of the mop head and the coupling portion of the second coupling element at the one end of the mop head extends outwardly of the mop head away from the second coupling element at said other end of the mop head, the second coupling elements presenting openings whereby said end portion of the handle may extend into the mop head selectively through either second coupling element, whereby the mop head may be mounted to the handle and the actuator selectively in either said first or said second condition, by insertion of said end of the handle into the mop head through a proximal one of said second coupling elements, and attaching the coupling portion of the first coupling element at said end of the handle to the coupling portion of a distal one of the second coupling elements, and attaching the coupling portion of the proximal second coupling element to the coupling portion of the first coupling element of the actuator.

22. A mop head as claimed in claim 21 wherein the coupling portions of the second coupling elements comprise externally threaded screw for threaded engagement with internal screw threads provided on the coupling portions of the first coupling elements, for attaching the coupling portions of the first and the second coupling elements.

* * * * *